US006139073A

United States Patent [19]

Heffner et al.

[11] Patent Number: 6,139,073

[45] Date of Patent: Oct. 31, 2000

[54] LOCK ASSEMBLY

[75] Inventors: Steven P. Heffner, La Grange; Fotios Golemis, Skokie, both of Ill.

[73] Assignee: Westinghouse Air Brake Company, Wilmerding, Pa.

[21] Appl. No.: 09/143,674

[22] Filed: Aug. 31, 1998

[51] Int. Cl.[7] ..... E05C 3/06

[52] U.S. Cl. ..... 292/201; 292/217; 292/DIG. 65

[58] Field of Search ..... 292/201, 216, 292/217, 214, 215, DIG. 65, DIG. 43; 70/279.1, 283

[56] References Cited

U.S. PATENT DOCUMENTS

| | | | |
|---|---|---|---|
| 3,621,686 | 11/1971 | Klein | 292/167 |
| 4,588,217 | 5/1986 | Escaravage | 292/201 |
| 4,917,420 | 4/1990 | Rogers, Jr. | 292/198 |
| 4,927,196 | 5/1990 | Girard et al. | 292/201 |
| 4,968,074 | 11/1990 | Yamagishi et al. | 292/201 |
| 4,976,477 | 12/1990 | Nakao | 292/201 |
| 4,978,153 | 12/1990 | Hirsch et al. | 292/201 |
| 5,257,840 | 11/1993 | Rouzaud | 292/201 |
| 5,497,640 | 3/1996 | Kokuryo | 70/237 |
| 5,593,191 | 1/1997 | DeMarco | 292/144 |
| 5,613,716 | 3/1997 | Cafferty | 292/216 |
| 5,632,515 | 5/1997 | Dowling | 292/216 |
| 5,901,992 | 5/1999 | Winkler | 292/270 |

*Primary Examiner*—Darnell M. Boucher
*Assistant Examiner*—Clifford B Vaterlaus
*Attorney, Agent, or Firm*—James Ray & Associates

[57] ABSTRACT

A door lock for locking a sliding door on a transit vehicle. The lock has a base for attachment to the transit vehicle and a lock cam having a slot for engaging a door lock element attached to the door. A pivot is connected to the base and to the lock cam to provide a rotary connection of the lock cam to the base. A lock actuator is attached to the base. The lock actuator includes a moveable actuator portion for engaging the lock cam to prevent rotation of the lock cam to lock the door. The actuator also has an energized actuator portion for withdrawing the moveable actuator portion from engagement with the lock cam to release the lock cam and unlock the door. The energized actuator portion is connectable with a control system for the transit vehicle door. The lock also has a manual release mounted to engage the moveable actuator portion to move it from engagement with the lock cam to release the lock cam and hence unlock the door. A sprag engaged with the manual release prevents locking of the door after the manual release has been used.

26 Claims, 14 Drawing Sheets

LOCK ASSEMBLY

FIELD OF THE INVENTION

The present invention relates, in general, to door locks for passenger transit vehicle type doors and, more particularly, this invention relates to door locks for sliding doors utilized in a passenger transit vehicle.

BACKGROUND OF THE INVENTION

The design and construction of passenger transit vehicle doors is crucial for the safety of the travelling public. These doors must function in a hostile environment which at least includes heavy usage, relatively large temperature extremes, vibration loads, acceleration loads and spurious electrical signals. Such spurious electrical signals may be caused by lightning, by interrupted contact with a third rail, and/or strong radio signals. They must function reliably for a very large number of cycles. For many applications, they must be designed to function rapidly and safely without the direct observation thereof by an operator of the transit vehicle.

The doors should have locks so that they cannot be opened by application of opening forces to the doors when the doors are closed and locked without energization of the locks in the unlocking direction. For safe and reliable operation, the doors also require sensors which indicate whether or not they are locked in the closed position. No credible failure mode should cause a door to open sufficiently for a person to fall out of the transit vehicle when the transit vehicle is moving.

It is generally necessary for the doors to have a manual unlocking means so that in the event of a failure of a control system which controls a door, or failure of an unlocking actuator, the door can be manually unlocked for emergency egress from the transit vehicle. It is desirable for the unlocking means to first unlock the door and to then move the door a small distance in the opening direction to provide a grip for a person to open the door fully.

Some prior art door locks use the mechanism which opens and closes the door to keep the door closed. This approach has the disadvantage that when the door is closed and locked forces on the door in the door opening direction are borne by the opening and closing mechanism. Some of these prior art door locks have the further disadvantage that if a spurious signal is received to open the door the door will unlock and open.

SUMMARY OF THE INVENTION

The present invention provides a door lock for locking a sliding door on a passenger transit vehicle. The lock has a base member for attachment to the transit vehicle and a lock cam having a slot formed therein for engaging a door lock element attached to the door. A pivot is connected to the base member and to the lock cam to provide a rotary connection of the lock cam to such base member. A lock actuator is attached to the base member. Such lock actuator includes a moveable actuator portion for engaging the lock cam to prevent unwanted rotation of the lock cam to lock the door. The actuator also has an energized actuator portion for withdrawing the moveable actuator portion from engagement with the lock cam to release the lock cam and unlock the door. The energized actuator portion is attached to a control system for the transit vehicle door. The lock further includes a manual release operable by a person. The manual release is mounted to engage the moveable actuator portion to move it from engagement with the lock cam to release the lock cam and hence unlock the door.

OBJECTS OF THE INVENTION

It is, therefore, one of the primary objects of the present invention to provide a door lock for a passenger transit vehicle which provides a positive lock in which door opening forces on a locked door are borne by the lock itself and are not carried by the actuating means which opens and closes the door.

Another object of the present invention is to provide a passenger transit vehicle door lock which requires an unlock signal and which cannot be unlocked by a spurious signal to the door opening and closing actuator.

An additional object of the present invention is to provide a passenger transit vehicle door lock which requires minimal modification of the door to install.

A further object of the present invention is to provide a transit vehicle door lock which engages a pin on the door.

Still another object of the present invention is to provide a transit vehicle door lock which employs a lock cam to capture a pin on the door.

Yet another object of the present invention is to provide a transit vehicle door lock which is positively immobilized in the locked position by a lock actuator.

A further object of the present invention is to provide a transit vehicle door lock which has a manual unlocking means for unlocking the door.

It is an additional object of the present invention to provide a manual unlocking means which unlocks a transit vehicle door and then moves it a small distance in the unlocking direction so that a person may see that the door is unlocked and obtain a grip to open the door fully.

Another object of the present invention is to provide a transit vehicle door lock having a manual unlocking means which must be reset before such door can be locked.

Still another object of the present invention is to provide a transit vehicle door lock having a manual unlocking means and a manual resetting means to reset such lock so that the door can be locked.

A further object of the present invention is to provide a transit vehicle door lock having a manual unlocking means which remains within the original envelope after manual unlocking so as not to protrude into the door opening.

Still yet another object of the present invention is to provide a transit vehicle door lock having at least one sensor to provide a signal indicating that the door is locked.

Yet still another object of the present invention is to provide a transit vehicle door lock having at least one sensor to provide a signal indicating that the door has been manually unlocked.

A still further object of the present invention is to provide a transit vehicle door lock which has a sensor mounted to indicate the door is in the closed position.

It is also an object of the present invention to provide a transit vehicle door lock in which an opening force applied to the door increases the lock engagement force.

In addition to the various objects and advantages of the present invention which have been generally described above, there will be various other objects and advantages of the invention that will become more readily apparent to those persons who are skilled in the relevant art from the following more detailed description of the invention, particularly, when the detailed description is taken in conjunction with the attached drawing figures and with the appended claims.

Figure 1:
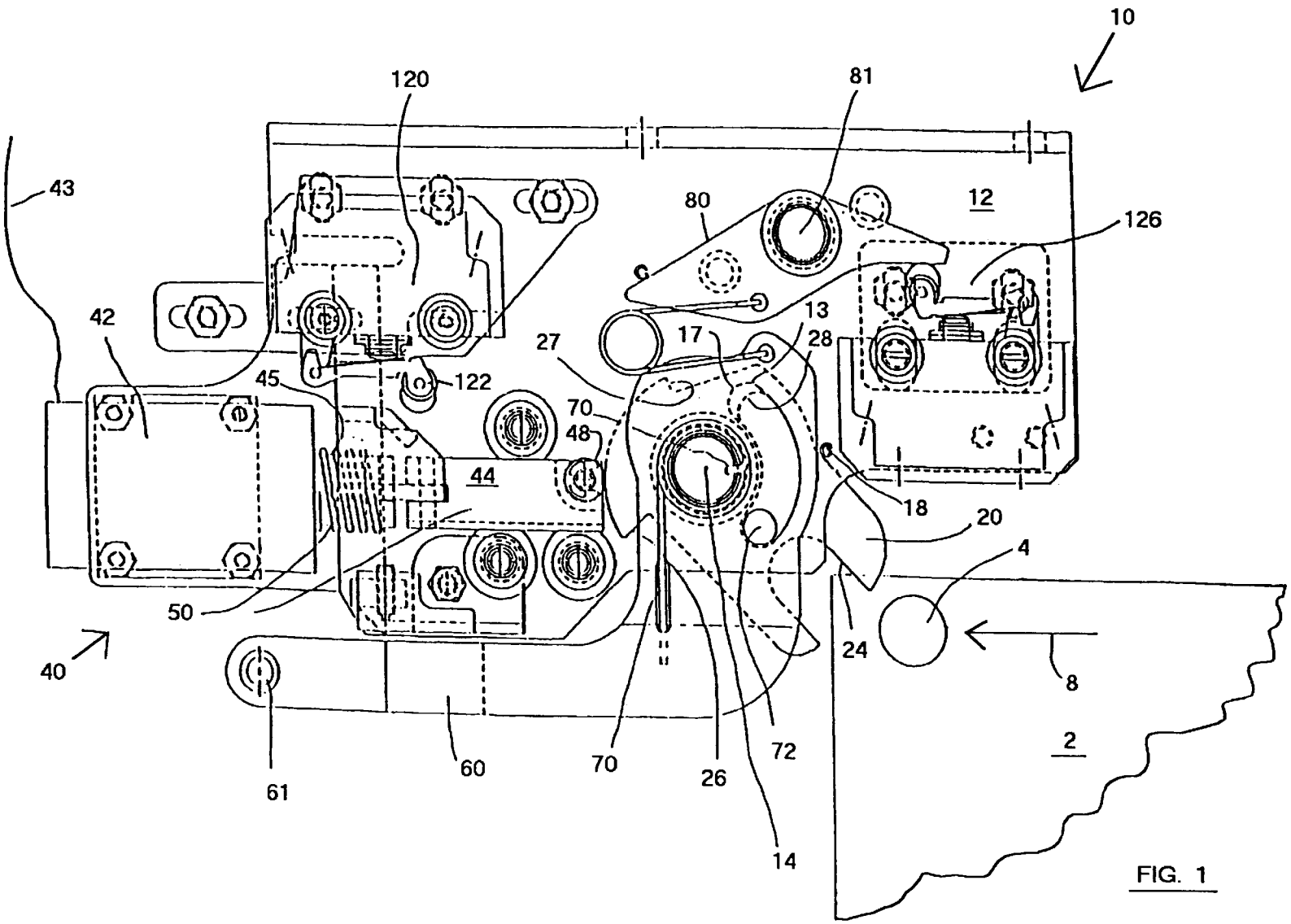
FIG. 1 is a schematic front elevation view of a presently preferred embodiment of the inventive door lock in an unlocked position with the door open and moving toward the closed position.

BRIEF DESCRIPTION OF THE PRESENTLY PREFERRED AND VARIOUS ALTERNATIVE EMBODIMENTS OF THE INVENTION

Prior to proceeding to the much more detailed description of the present invention, it should be noted that identical components which have identical functions have been identified with identical reference numerals throughout the several views illustrated in the drawing figures, for the sake of clarity and understanding of the invention.

Figure 2:
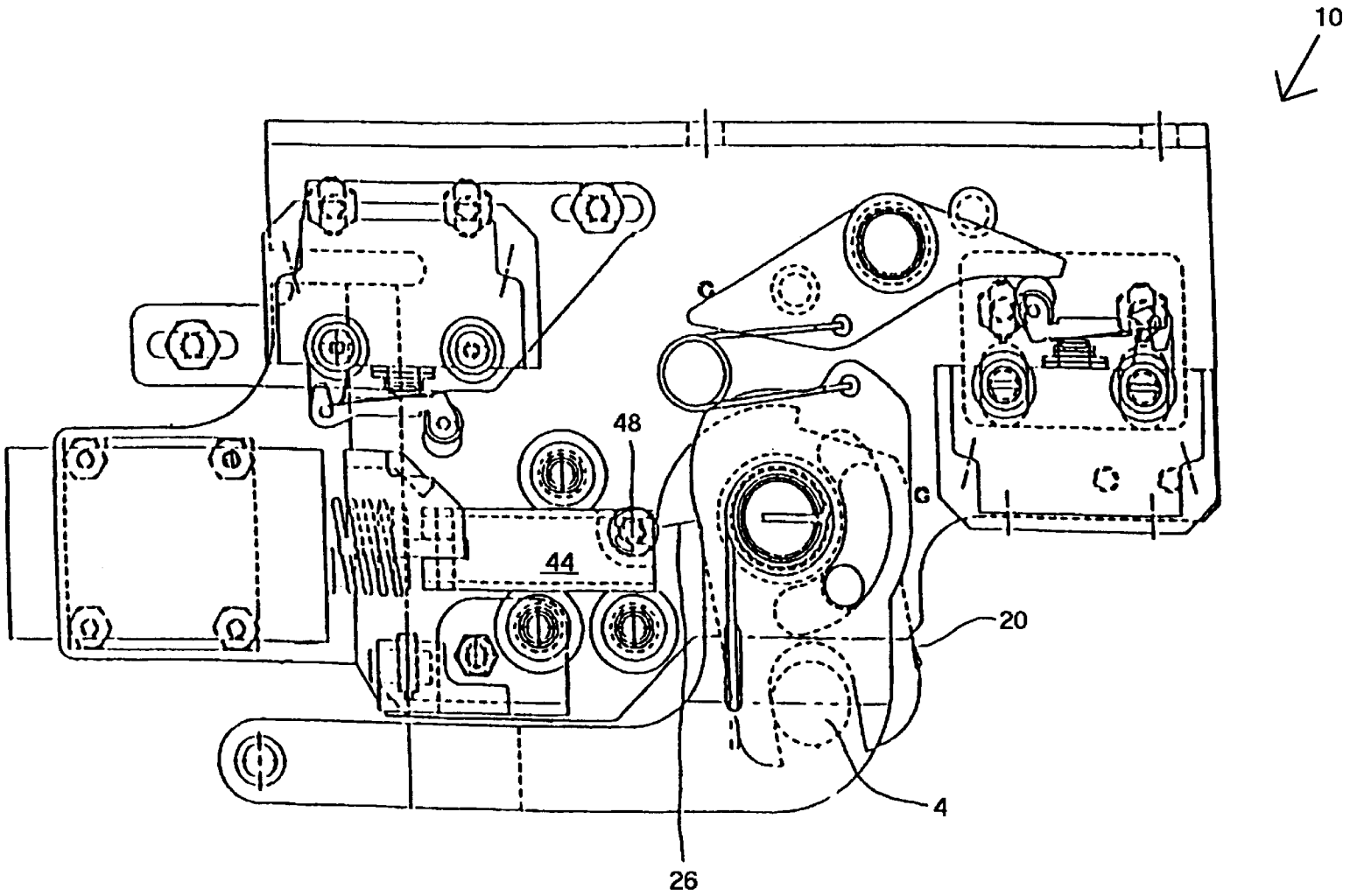
FIG. 2 is a schematic front elevation view of the door lock illustrated in FIG. 1 showing the lock cam engaging the door lock element on the door as the door is being locked.
Figure 3:
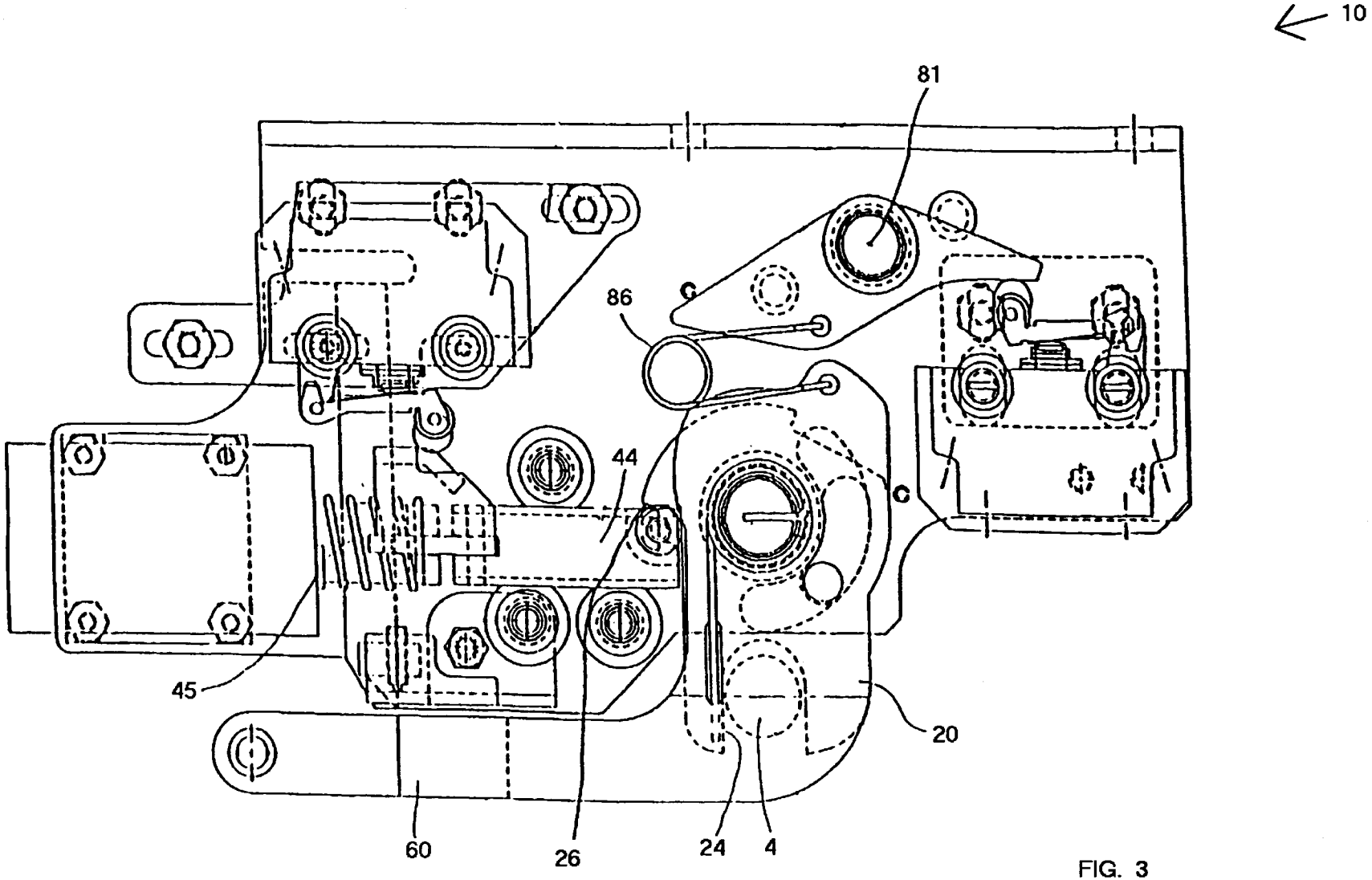
FIG. 3 is a schematic front elevation view of the door lock illustrated in FIG. 1 in the locking position.

Reference is now made, more particularly, to FIGS. 1, 2 and 3, wherein most features of a presently preferred embodiment of the invention are illustrated. The present invention provides a door lock, generally designated 10, for locking a door 2 on a passenger transit type vehicle (not shown). The door lock 10 includes a base member 12 for attachment to the transit vehicle and a lock cam 20. Such lock cam 20 has a slot 24 for engaging a door lock element, such as pin 4, attached to the door 2. A pivot 14 is connected to both base member 12 and lock cam 20 to provide a rotary connection of such lock cam 20 to the base member 12. A lock actuator 40 is attached to the base member 12. Such lock actuator 40 includes a moveable actuator portion 50 for engaging the lock cam 20 in order to prevent rotation of the lock cam 20 to lock the door 2.

In the preferred embodiment shown, the moveable actuator portion 50 has a lock bar 44 which engages a lock step 26 on such lock cam 20 in order to prevent rotation of the lock cam 20 when the door 2 is locked. The lock actuator 40 also includes an energized actuator portion 42 for withdrawing the moveable actuator portion 50 from engagement with the lock cam 20 to release the lock cam 20 and unlock the door 2.

The energized actuator portion 42 is an electrical actuator which, in the presently preferred embodiment, is a solenoid. The energized actuator portion 42 is connectable with a control system (not shown) for the transit vehicle door 2. The energized actuator portion 42 includes a control connection 43. Such control connection 43, preferably, is an electrical connection. It is presently preferred that the lock cam 20 have a biasing means, preferably a torsion spring (not shown in these Figures), for biasing it against a lock cam stop, preferably pin 18, to position such lock cam 20 in an unlocked position.

The door locking process for the door lock 10 illustrated in FIGS. 1, 2 and 3 is believed to be evident. FIG. 1 shows both the door 2 and the door lock pin 4 in an unlocked position. Such door 2 is movable in a door closing direction, as indicated by the arrow 8.

In FIG. 2, such door lock pin 4 is shown in a slot engaging position in which it is engaged by such slot 24 formed in the lock cam 20. In this Figure, the lock cam 20 is illustrated in a door lock pin 4 engaging position and the lock bar 44 is also shown in an unlocking position. It is presently preferred that such lock bar 44 include a lock bar roller 48 which engages the lock cam 20 in order to substantially minimize undesirable friction with such lock cam 20.

In FIG. 3, door lock pin 4 is shown in a locked position and has rotated the lock cam 20 to a lock cam locking position. Lock bar 44 is in a lock bar locking position adjacent lock step 26 disposed on the lock cam 20. In the locking position, lock bar 44 contacts the lock step 26. It is presently preferred that moveable actuator portion 50 including the lock bar 44 have a biasing means, preferably coil spring 45, mounted in compression to bias such lock bar 44 against the lock cam 20.

Figure 4:
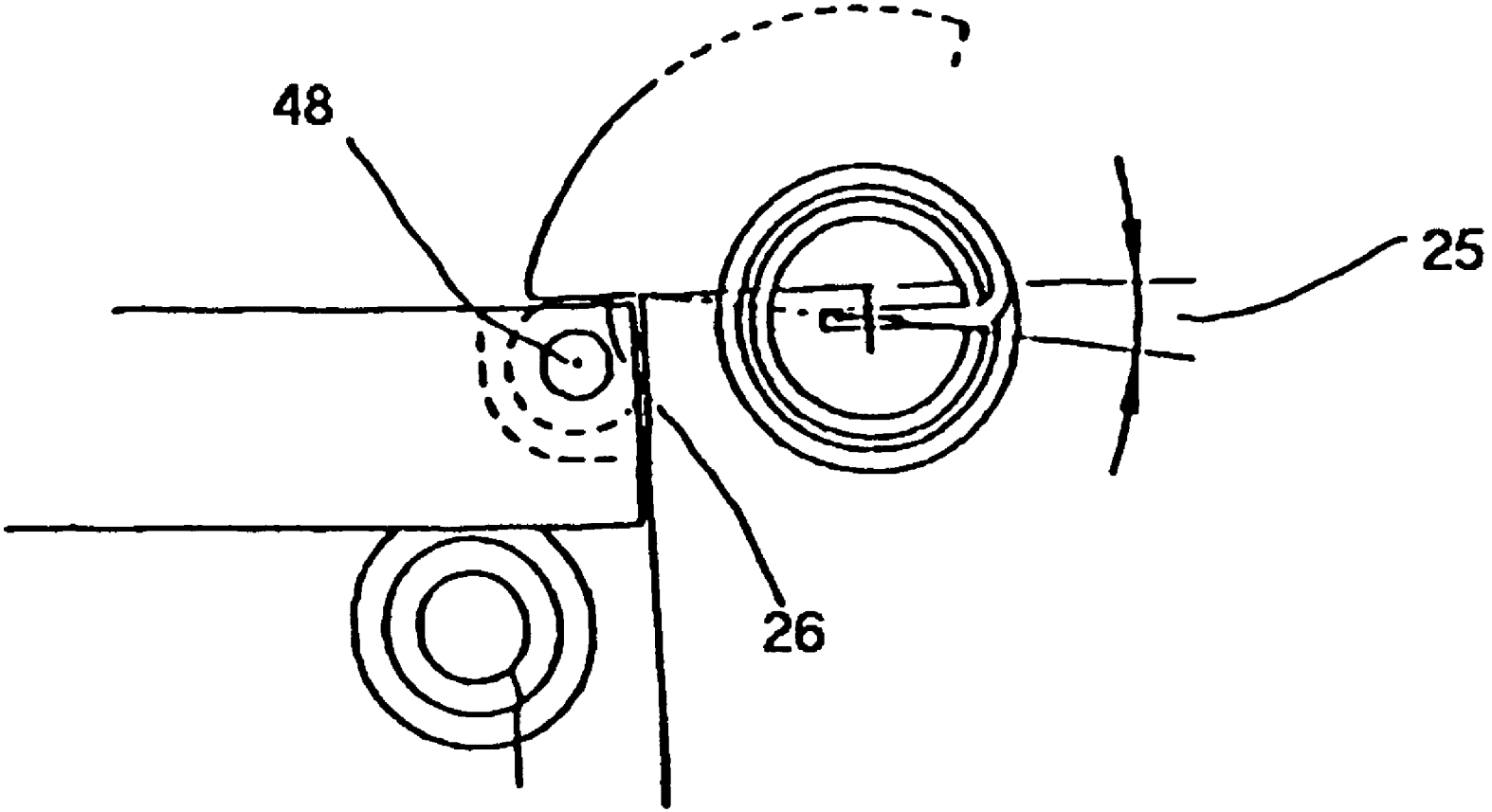
FIG. 4 is a schematic front elevation view which illustrates an undercut angle on the lock cam so that when the door is locked any force tending to open the door will increase the locking forces.

Reference is now made to FIG. 4 which illustrates in detail the lock step 26 which, preferably, includes an undercut angle 25. Such undercut angle 25 is provided so that a door opening force exerted on the door 2, which would tend to rotate such lock cam 20, increases the engagement force of the lock bar 44 with such lock cam 20.

Figure 5:
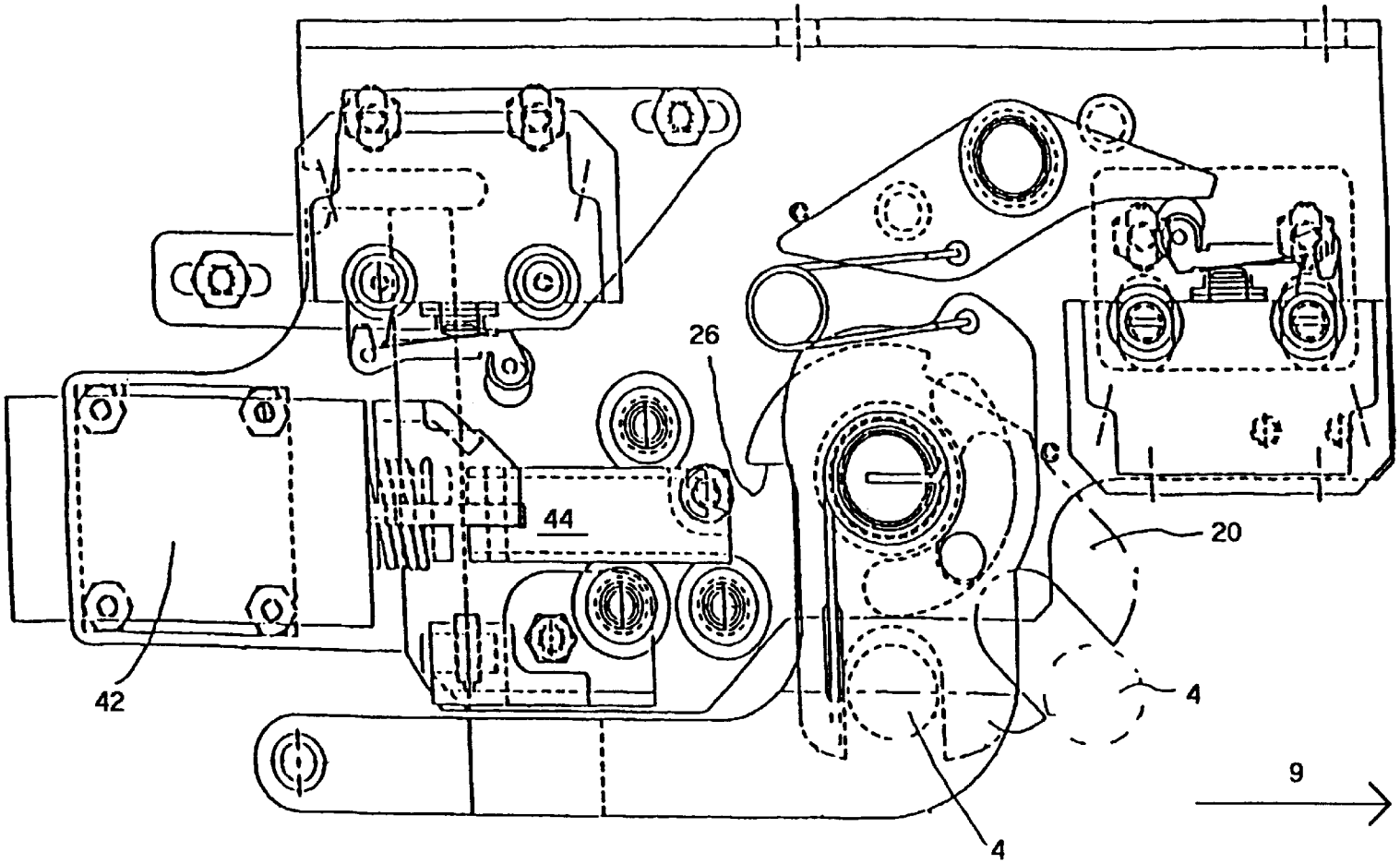
FIG. 5 is a schematic front elevation view showing the door lock illustrated in FIG. 1 when the lock actuator is energized to unlock the door.

Refer now to FIG. 5. As can be seen therein, the energized actuator portion 42 has caused withdrawal of the lock bar 44 from engagement with such lock cam 20. Lock cam 20 is then free to rotate and permits the door lock pin 4 to be moved in the door opening direction, as indicated by the arrow 9, from the locked position to the unlocked position.

The operation of a manual release, preferably a lever 60, of the door lock 10 is believed evident for such door lock 10 as illustrated in FIG. 3 and FIGS. 6 through 9. Manual release lever 60 is operable to engage the moveable actuator portion 50 to move the lock bar 44 from engagement with the lock cam 20 to release the lock cam 20 and hence unlock the door 2. Manual release lever 60 is used to unlock the door 2 in the event that such energized actuator portion 42 is unavailable for withdrawing such moveable actuator portion 50 from engagement with such lock cam 20. Manual release lever 60 is normally in a position in which the manual release lever 60 does not engage such lock bar 44. It is preferred that such manual release lever 60 have a handle 61 to facilitate use thereof by a person.

Figure 6:
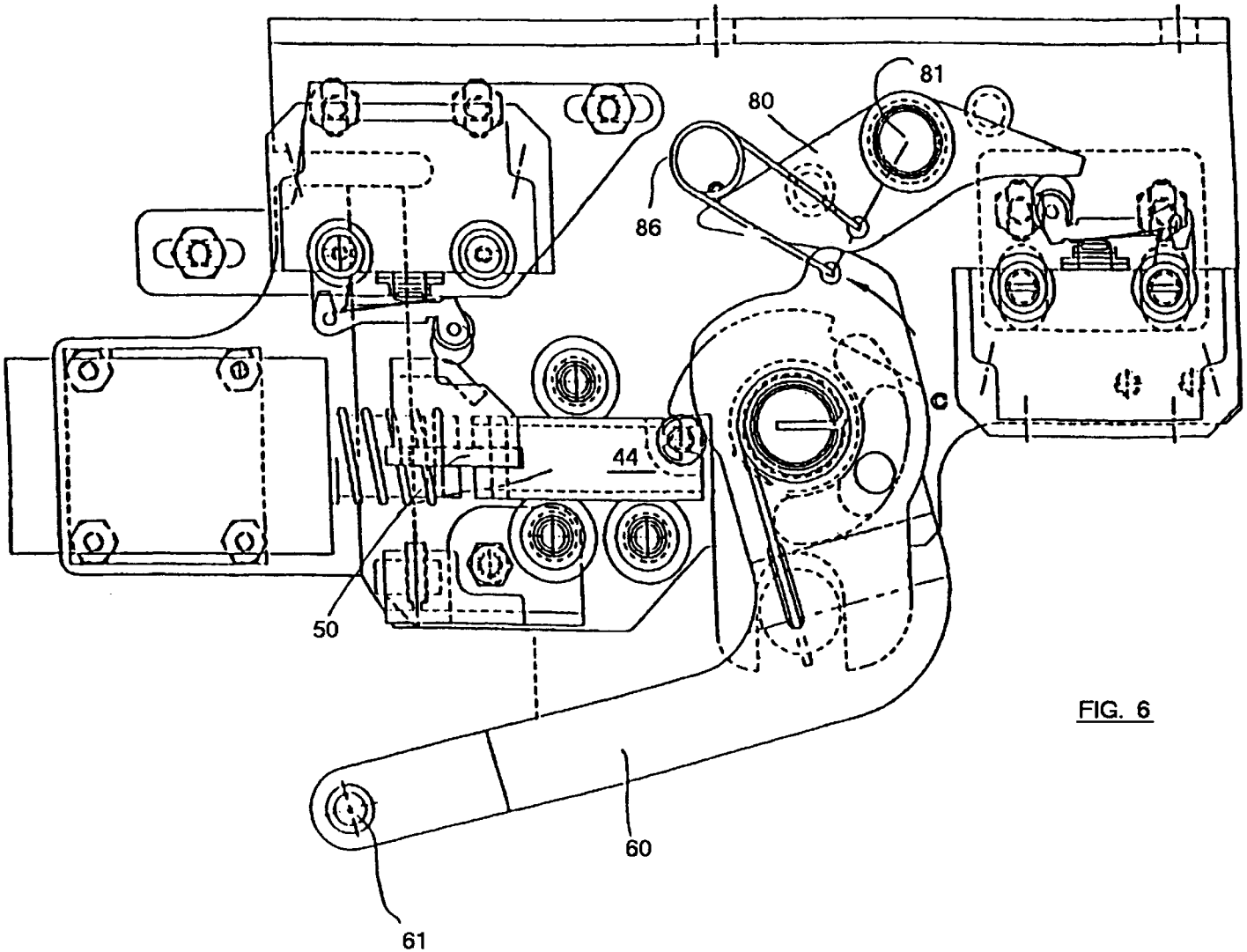
FIG. 6 is a schematic front elevation view which illustrates a manual release lever to enable the door to be unlocked manually by rotation of the manual release lever.

A sprag 80 is mounted on pivot 81 and serves to retain the lock cam 20 in its unlocking position after manual unlocking. Sprag 80 is connected to the manual release lever 60 by a sprag spring 86. FIG. 3 illustrates the manual release lever 60 in its normal position. In this position, sprag spring 86, preferably, biases sprag 80 to its normal position, as seen in FIG. 1. FIG. 6 shows the manual release lever 60 moved to a position in which the sprag spring 86 reaches an unstable position aligned with the sprag pivot 81.

Figure 7:
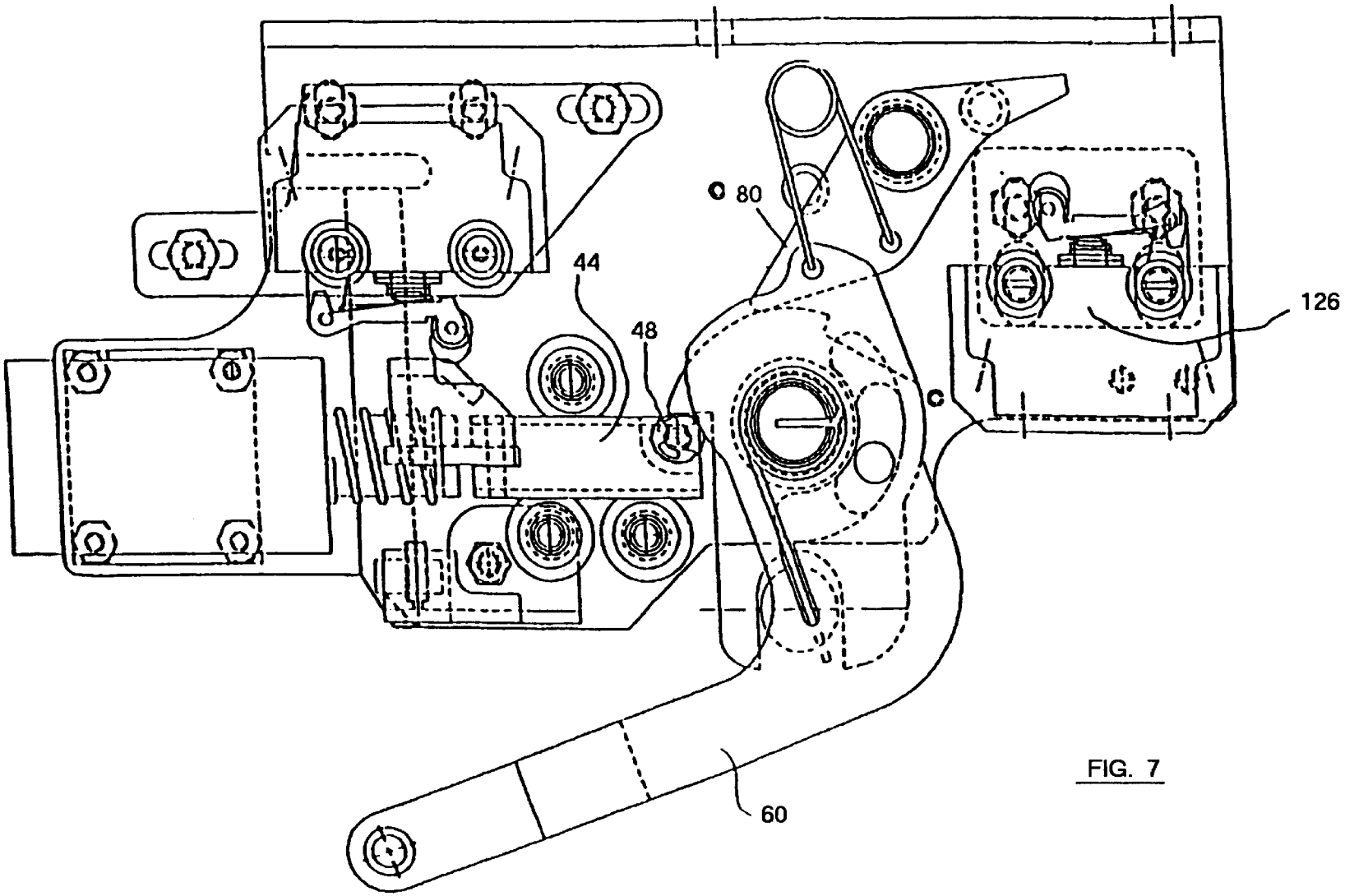
FIG. 7 is a schematic front elevation view which illustrates the manual release lever shown in FIG. 6 further rotated into a position in which a sprag contacts the lock cam.

Further motion of the manual release lever 60, to the position shown in FIG. 7, biases the sprag 80 toward the lock cam 20 and causes such sprag 80 to move to a position in which it rides on lock cam 20. A sprag sensor 126 is, preferably, included to indicate the position of such sprag 80 and to indicate whether the manual release lever 60 has been used. Sprag sensor 126 is connectable to a control system (not shown) for the door lock 10. In the position shown in FIG. 7, the manual release lever 60 begins to engage the roller 48 on such lock bar 44 to move the lock bar 44 from engagement with the lock cam 20.

Figure 8:
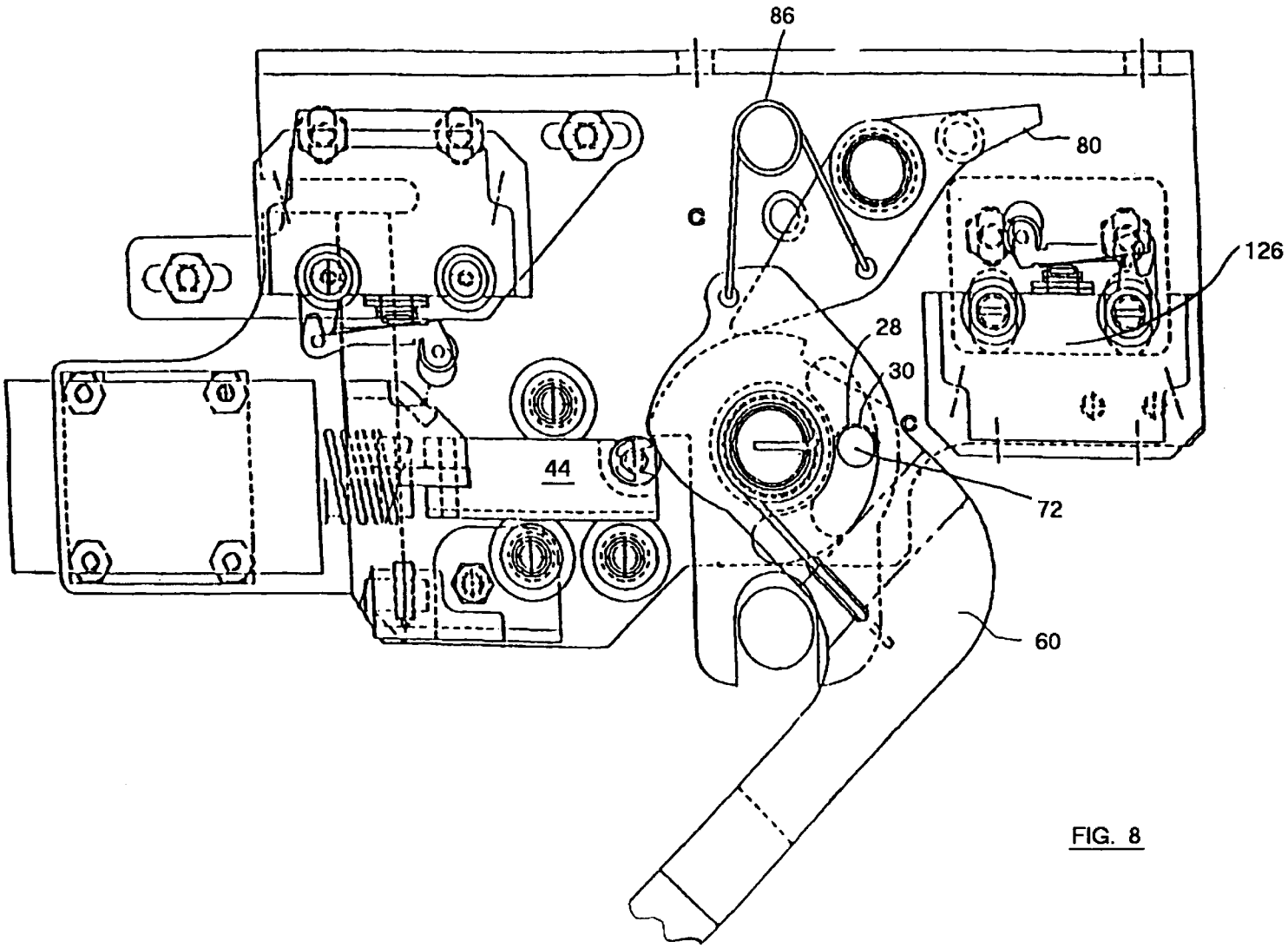
FIG. 8 is a schematic front elevation view which illustrates the manual release lever shown in FIG. 6 rotated into a position to unlock the door.
Figure 9:
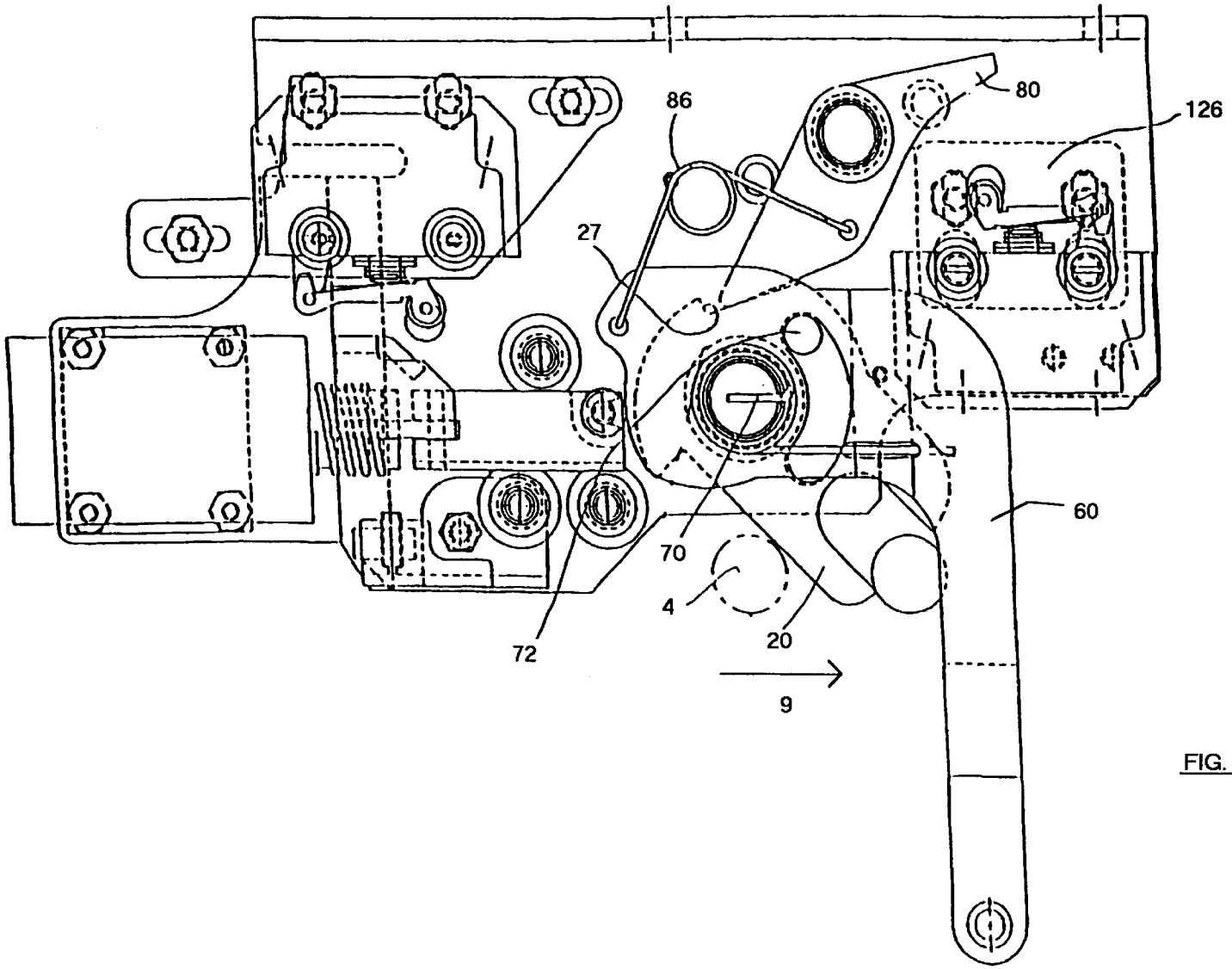
FIG. 9 is a schematic front elevation view which illustrates the manual release lever shown in FIG. 6 rotated into a fully rotated position.

Further motion of the manual release lever 60 to the position illustrated in FIGS. 8 and 9 enables the lock cam 20 to be unlocked. In the presently preferred embodiment of the invention, lock cam manual release lever 60 has a lock engaging portion, which preferably is a pin 72. Such pin 72 on the manual release lever 60 engages one end 30 of the arcuate slot 28 formed in the lock cam 20 when such manual release lever 60 is in the position shown in FIG. 8. Upon rotation of the manual release lever 60 from the position illustrated in FIG. 8 to the position shown in FIG. 9, the pin 72 rotates the lock cam 20 from the locked position to an unlocked position.

Figure 15:
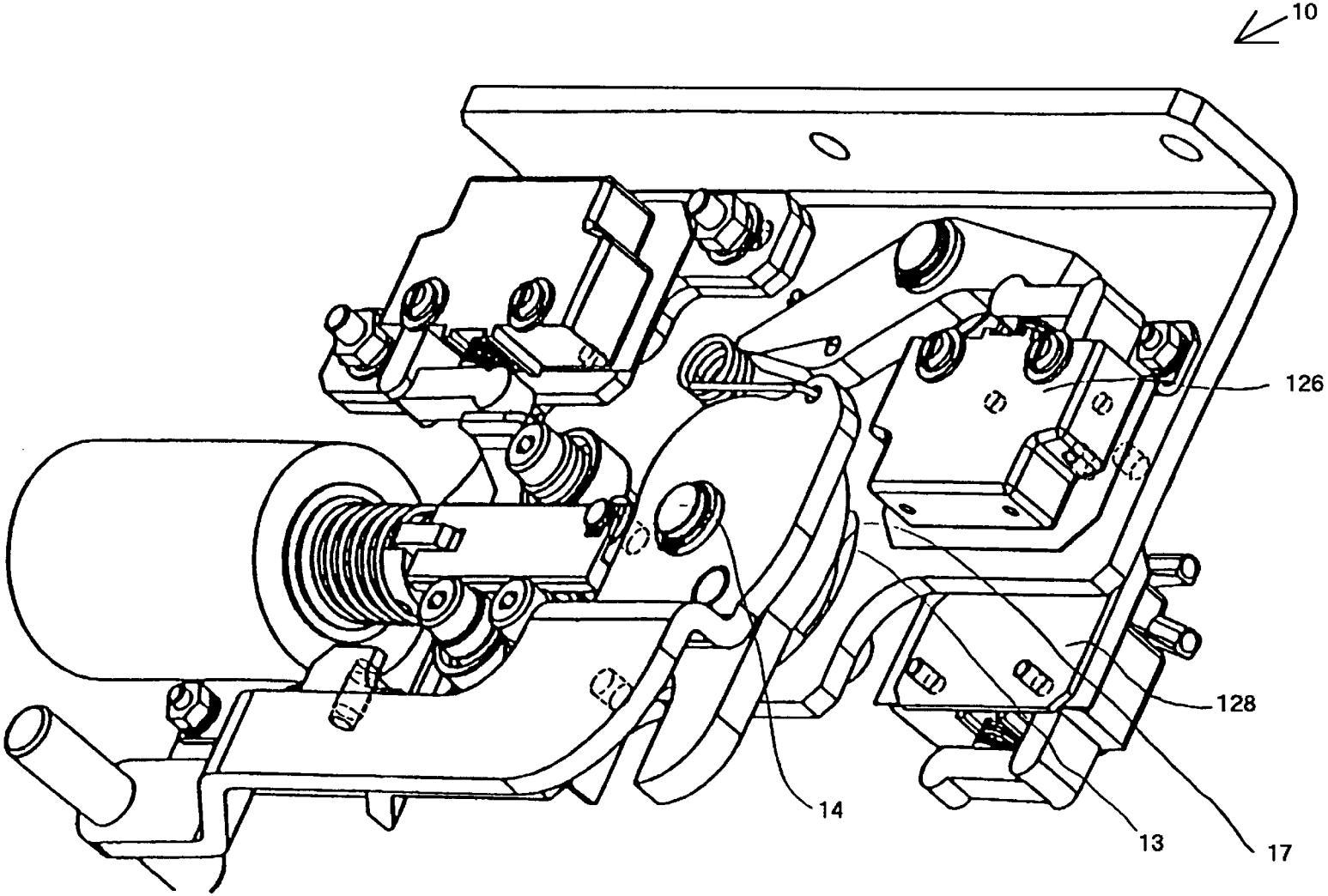
FIG. 15 is a perspective view which illustrates an alternative embodiment of the invention which incorporates a door position sensor.

This causes the door lock pin 4 and the door 2 to be moved a small distance in the opening direction 9. This is so that a person operating the manual release lever 60 can see that unlocking has occurred and obtain a grip on the door 2 in order to open it. When such manual release lever 60 is in the position shown in FIG. 9, the pin 72 on the manual release lever 60 encounters the end 17 of arcuate slot 13 in base member 12. This prevents further motion of such manual release lever 60. Such arcuate slot 13 is seen in FIGS. 1 and 15.

When the manual release lever 60 has reached the position shown in FIG. 9, the sprag 80 will have dropped behind the unlock step 27 on lock cam 20 so that such lock cam 20 is held in the unlocking position by such sprag 80. Sprag 80 is held in position by a sprag biasing spring 86. In the presently preferred embodiment, a resilient means, such as torsion spring 70, is connected to the manual release lever 60 to return such manual release lever 60 to its normal position.

To enable the door lock 10 to be locked after manual release, a sprag release 94 (FIG. 10) is provided in the presently preferred embodiment of the invention. When sprag release 94 is pulled downwards, sprag 80 is moved from the unlocking position to its normal position. The door lock 10 is then configured as shown in FIG. 1.

Figure 11:
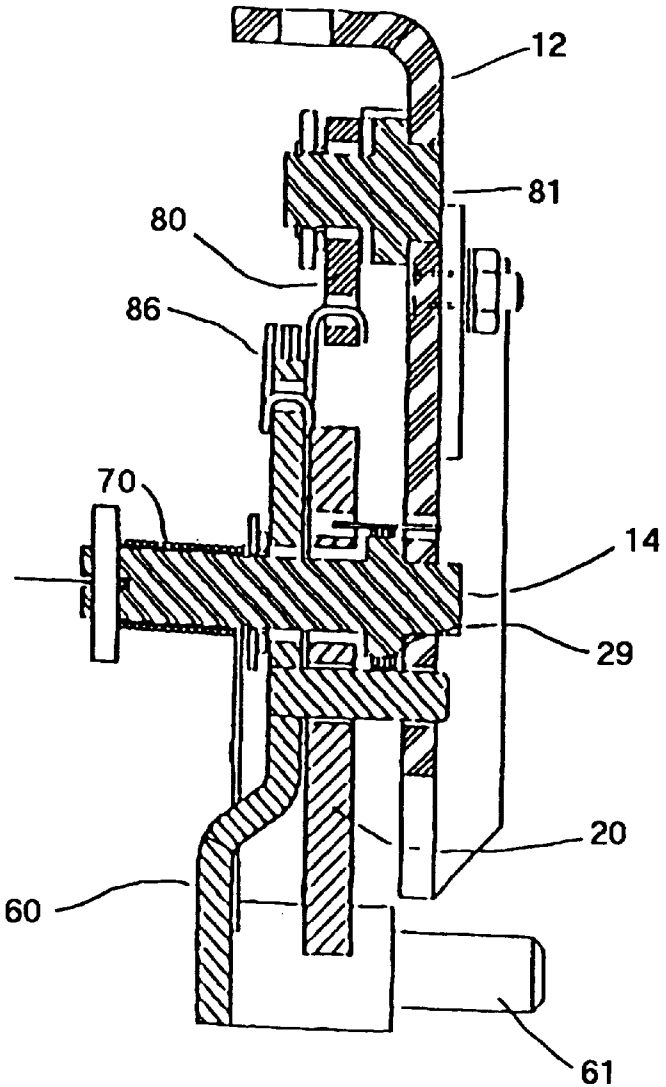
FIG. 11 is a vertical view partially in cross-section through the pivot which illustrates springs for the lock cam, manual releases ever and sprag.

Reference is now made to FIG. 11 which is a vertical section cut through the axis of the pin 14 which, preferably, is fixed to base member 12. In the presently preferred embodiment shown, the lock cam 20 and the manual release lever 60 are both rotatably mounted on pin 14. A lock cam biasing means, which preferably is a torsion spring 29, biases the lock cam 20 toward stop pin 18. This establishes a predetermined angular position for lock cam 20. Likewise, sprag spring 86 connects sprag 80 to the manual release lever 60. A sprag pivot 81 is fixed to the base member 12. FIG. 11 also shows a manual release return spring 70.

Figure 10:
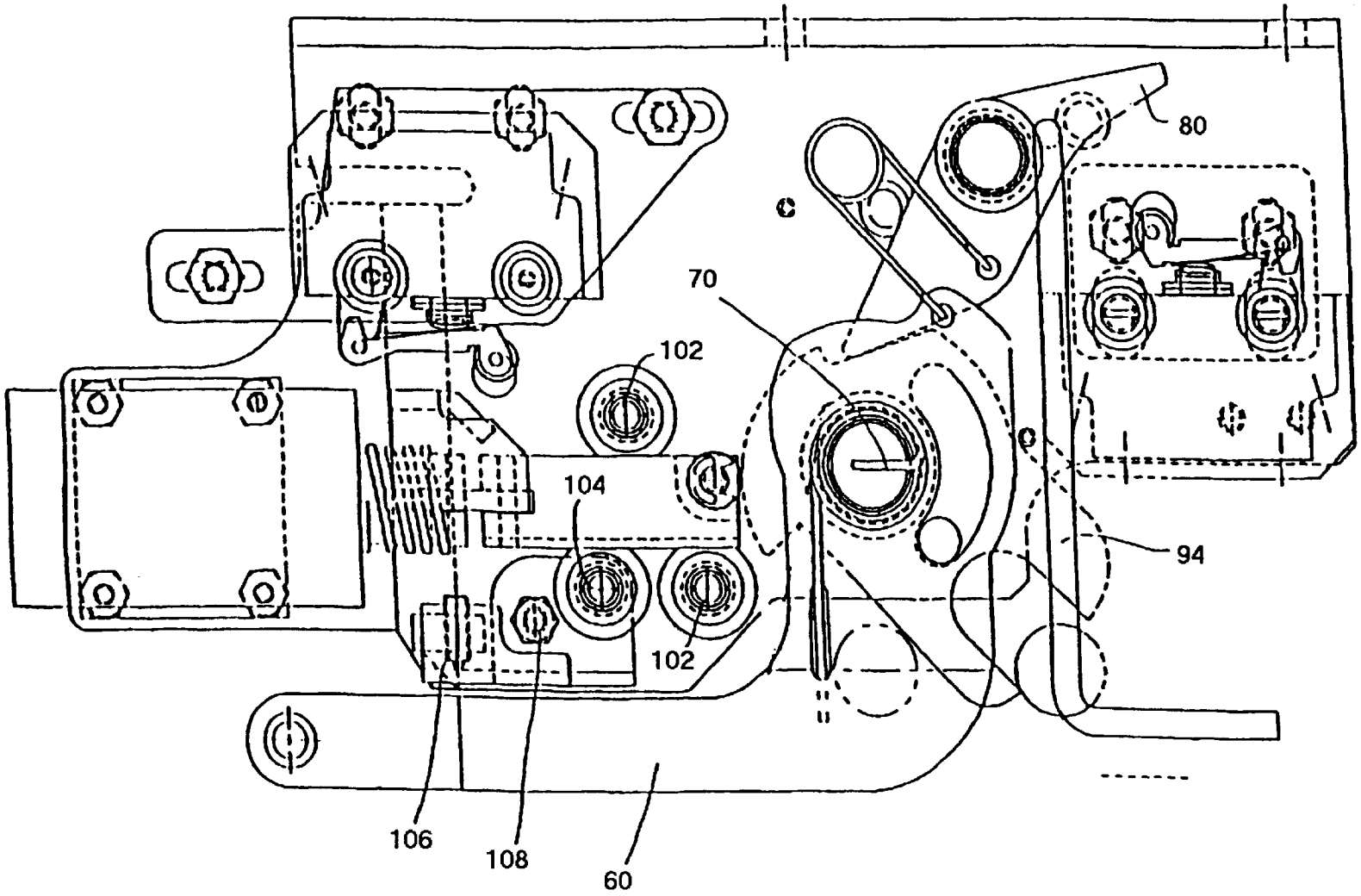
FIG. 10 is a schematic front elevation view which illustrates the manual release lever shown in FIG. 6 returned to its original position and the door lock held in the unlocking position.
Figure 12:
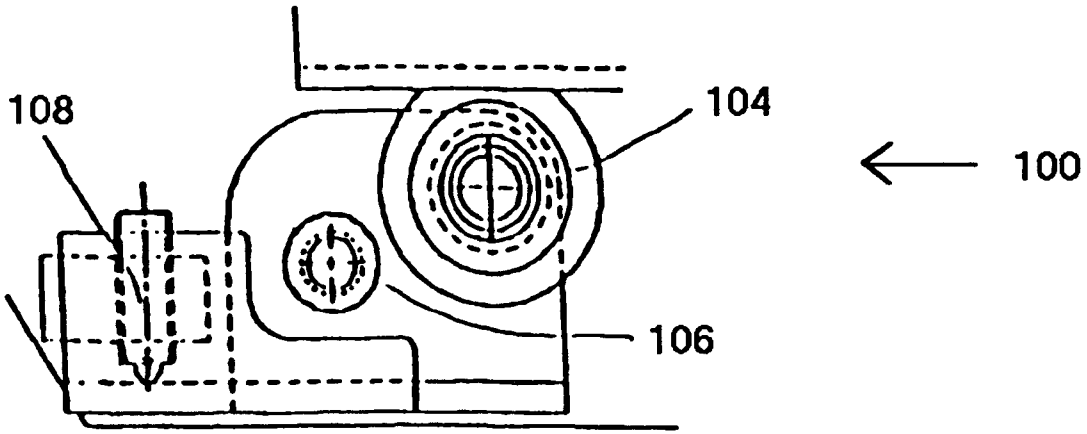
FIG. 12 is a front elevation view of the tensioner assembly used in the door lock illustrated in FIG. 1.
Figure 13:
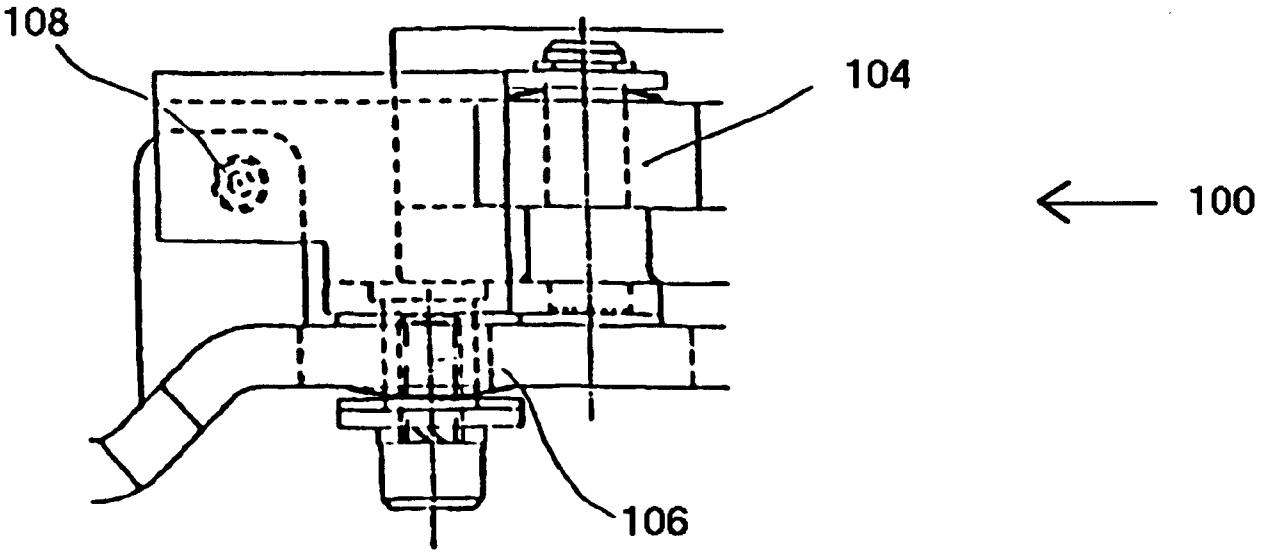
FIG. 13 is a plan view of the tensioner assembly illustrated in FIG. 12.

To enhance smoothness of operation, it is preferred that at least one fixed guide roller 102 engagable with lock bar 44, illustrated in FIG. 10, be included. In the presently preferred embodiment shown, two fixed guide rollers 102 are provided. It is also presently preferred that at least one moveable guide roller 104, biased to engage the lock bar 44, be included. As shown in greater detail in FIGS. 12 and 13, a tensioner assembly 100 is preferably mounted to rotate about pivot 106 to press a moveable guide roller 104 against lock bar 44. Biasing force is provided by spring pin 108.

Figure 14:
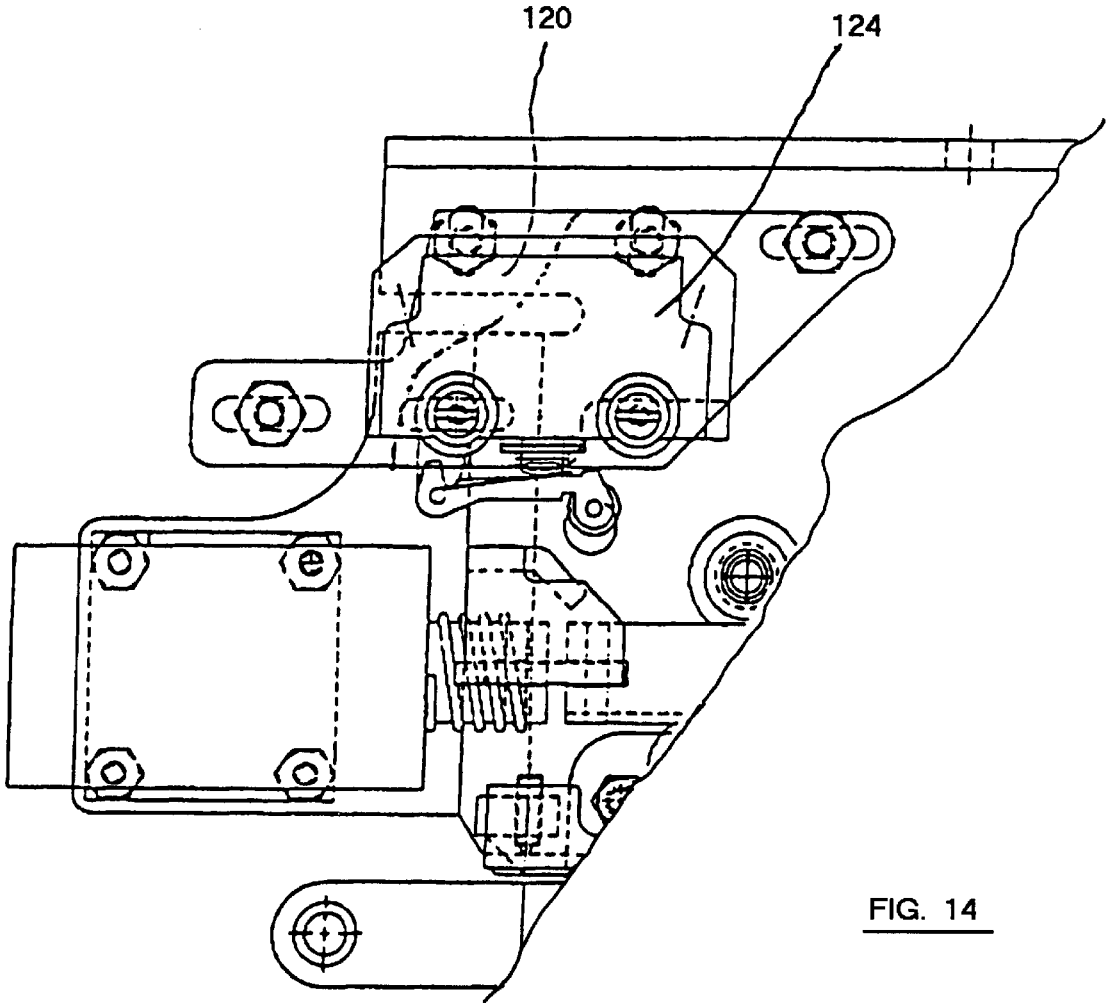
FIG. 14 is a partial front elevation view with a cutout showing a pair of actuator sensors used in the door lock illustrated in FIG. 1.

An actuator sensor 120, as best seen in FIG. 1, preferably includes a sensor displaceable portion 122 to provide a signal indicating the position of the moveable actuator portion 50. FIG. 14 shows a portion of such actuator sensor 120 cut away to show a second actuator sensor 124 which is preferably included for providing a second signal indicating the position of such moveable actuator portion 50. Actuator sensors 120 and 124 are connected to the control system for such door lock 10.

In the presently preferred embodiment of the invention, there is a door position sensor 128 (FIG. 15) provided for indicating the position of the door 2. Such door position sensor 128 is connected to the control system for the door lock 10.

While a presently preferred and various additional alternative embodiments of the instant invention have been described in detail above, in accordance with the patent statutes, it should be recognized that various other modifications and adaptations of the invention may be made by those persons who are skilled in the relevant art without departing from either the spirit of the invention or the scope of the appended claims.

We claim:

1. A door lock for locking a door on a passenger transit type vehicle, said door lock comprising:

(a) a base member engageable with such passenger transit type vehicle;

(b) a pivot means connected to said base member;

(c) a lock cam attached to said pivot means for rotary connection to said base member, said lock cam having a slot formed therein for engaging a door lock element attached to such door, said lock cam further having an unlock step;

(d) a lock actuator attached to said base member, said lock actuator including, (i) a moveable actuator portion for engaging said lock cam to prevent rotation of said lock cam to lock said door, and (ii) an energized actuator portion for withdrawing said moveable actuator portion from engagement with said lock cam to release said lock cam and unlock such door, said energized actuator portion being connectable to a control system for such passenger transit type vehicle door;

(e) a manual release means positioned to engage said moveable actuator portion for moving said moveable actuator portion from engagement with said lock cam in order to release said lock cam and unlock such door;

(f) a sprag engaged with said manual release means for engaging said unlock step to prevent locking of said door when said manual release means is used; and (g) means connected to said sprag for biasing said sprag into engagement with said lock cam after said manual release has been used so that said sprag must be reset before said door can be locked.

2. A door lock, according to claim 1, wherein said door lock further includes a lock cam biasing means and a lock cam stop which cooperate to orient said lock cam into a predetermined angular position when such door is unlocked and said predetermined angular position being for engaging such door lock element when such door is being locked.

3. A door lock, according to claim 2, wherein said lock cam biasing means is a torsion spring.

4. A door lock, according to claim 1, wherein said door lock further includes a biasing means engaged with said moveable actuator portion for urging said moveable actuator portion into engagement with said lock cam and to prevent rotation of said lock cam.

5. A door lock, according to claim 4, wherein said biasing means is a coil spring mounted in compression.

6. A door lock, according to claim 1, wherein said moveable actuator portion has an actuator roller for frictionless engagement with a perimeter of said lock cam when said lock cam is rotated.

7. A door lock, according to claim 6, wherein said moveable actuator portion includes a lock bar on which said actuator roller is mounted.

8. A door lock, according to claim 7, wherein said door lock further includes at least one fixed guide roller mounted on said base member to guide said lock bar.

9. A door lock, according to claim 8, wherein said door lock includes a pair of fixed guide rollers.

10. A door lock, according to claim 7, wherein said door lock further includes at least one moveable guide roller and means engaging said at least one moveable guide roller for biasing said at least one moveable guide roller into engagement with said lock bar to enhance smoothness of operation.

11. A door lock, according to claim 1, wherein a perimeter of said lock cam includes a lock step engageable with said moveable actuator portion to prevent rotation of said lock cam when such door is locked.

12. A door lock, according to claim 11, wherein said lock step includes an undercut angle so that a door opening force exerted on such door and reacted by said lock cam will tend to increase a force engaging said moveable actuator portion with said lock cam.

13. A door lock, according to claim 1, wherein said energized actuator portion of said lock actuator is an electrical actuator.

14. A door lock, according to claim 13, wherein said electrical actuator includes an electrical control connection for connecting said electrical actuator to such control system.

15. A door lock, according to claim 1, wherein said manual release means is a lever, said lever having a first position wherein it does not unlock said door and a second position for unlocking said door.

16. A door lock, according to claim 15, wherein said lever is mounted for rotary motion about said pivot.

17. A door lock, according to claim 15, wherein said lever further includes a handle portion to facilitate manual actuation thereof.

18. A door lock, according to claim 1, wherein said manual release means includes a lock cam engaging portion for rotating said lock cam to move such door in a door opening direction after said moveable actuator portion has released said lock cam.

19. A door lock, according to claim 18, wherein said lock cam engaging portion is a pin member mounted on said manual release means.

20. A door lock, according to claim 19, wherein said lock cam includes an arcuate slot for engagement with said pin member on said manual release means.

21. A door lock, according to claim 1 further including a manual sprag reset for resetting said sprag after said manual release means has been used.

22. A door lock, according to claim 15, wherein said door lock further includes a resilient means connected to said manual release means for returning said manual release means to said first position after such door has been manually unlocked.

23. A door lock, according to claim 1, wherein said door lock further includes a sprag sensor to detect a position of said sprag to provide an indication that said manual release means has been used, said sprag sensor being connectable to such control system.

24. A door lock, according to claim 1, wherein said door lock further includes a lock actuator sensor for determining a position of said moveable actuator portion, said lock actuator sensor being connectable to such control system.

25. A door lock, according to claim 24, wherein said lock actuator sensor is a first lock actuator sensor and said door lock further includes a second lock actuator sensor, said second lock actuator sensor being connectable to such control system.

26. A door lock, according to claim 1, wherein said door lock further includes a door sensor to detect such door when such door is closed, said door sensor being connectable to such control system.

* * * * *